US008092116B1

(12) United States Patent
Asplin

(10) Patent No.: US 8,092,116 B1
(45) Date of Patent: Jan. 10, 2012

(54) SLAB RAISING METHOD

(76) Inventor: Charles Lee Asplin, Fargo, ND (US)

( * ) Notice: Subject to any disclaimer, the term of this patent is extended or adjusted under 35 U.S.C. 154(b) by 0 days.

(21) Appl. No.: 12/854,332

(22) Filed: Aug. 11, 2010

(51) Int. Cl.
*E01C 23/10* (2006.01)

(52) U.S. Cl. ..... 404/78

(58) Field of Classification Search ..... 404/78
See application file for complete search history.

(56) References Cited

U.S. PATENT DOCUMENTS 5,561,914 A 10/1996 Asplin
5,860,763 A 1/1999 Asplin
5,979,879 A 11/1999 Asplin
6,976,804 B1 12/2005 Asplin
7,226,274 B1 6/2007 Asplin
7,461,997 B1 * 12/2008 Mack, II ..... 404/78
2006/0117678 A1 * 6/2006 Neighbours ..... 52/125.1

OTHER PUBLICATIONS

U.S. Appl. No. 09/687,445, filed Oct. 13, 2000 (23 pages).
U.S. Appl. No. 10/649,421, filed Aug. 26, 2003 (35 pages).

* cited by examiner

*Primary Examiner* — Raymond Addie
(74) *Attorney, Agent, or Firm* — Hamre, Schumann, Mueller & Larson, P.C.

(57) ABSTRACT

A method of raising a slab is described here that uses inflatable hoses to raise slabs needing to be raised, for example, to raise sunken slabs of a roadway to align to their adjacent slabs without closing the roadway and breaking ongoing traffic. The described method of raising a slab makes it more efficient to repair slabs needing to be raised while conventional repairing methods, for example, re-pouring, or mud jacking, which need to close the roadway and interrupt ongoing traffic, are more expensive, time consuming and less effective.

20 Claims, 4 Drawing Sheets

SLAB RAISING METHOD

FIELD

This disclosure relates to a method of raising an existing slab which has settled.

BACKGROUND

Over time, portions of roadways, driveways, garage floors, sidewalks, patios, etc., often have a tendency to settle or sink. One area that is prone to settlement is a roadway slab adjacent to a bridge. This creates step-like structures or cracks to occur between sections of slabs or at joints.

There are several conventional ways to repair sunken slabs. One of these ways is to remove the damaged slab and then re-form the slab. Another method that is often used is mud jacking. In this repair method a hole is drilled through the sunken slab and wet mud is pumped under the slab until the slab is returned to its original position.

SUMMARY

A method of raising a slab is described that raises slabs needing to be raised. The described method is more efficient than conventional repairing methods such as slab re-forming and mud jacking.

In one specific application, the described method can be used to raise a sunken slab of a roadway to align to an adjacent slab without closing the roadway and breaking ongoing traffic. In contrast, slab re-reforming and mud jacking need to close at least portions of the roadway and interrupt ongoing traffic while implementing the repair.

In one disclosed example, a method of raising a slab resting on the ground includes introducing an inflatable hose underneath at least a portion of the slab needing to be raised. The inflatable hose is disposed between a bottom surface of the slab and the ground. The slab is lifted by inflating the hose with pressurized media so that the hose increases in volume to impose an upward force on the slab.

In another disclosed example, a method of slab jacking includes positioning an inflatable hose underneath at least a portion of a slab needing to be raised. The inflatable hose is positioned underneath the slab so as to be able to impose an upward lifting force on the slab when the hose is inflated. The hose is inflated with pressurized media so that the hose increases in volume to impose an upward force on the slab to lift the slab. Fill material is introduced into a space that is created underneath the slab when the slab is lifted. The inflated hose is then deflated and fill material is introduced into a void left by deflating the inflated hose.

DRAWINGS

FIG. 1(*b*) is a side elevation cross sectional view of FIG. 1(*a*) taken along line A-A'.

FIG. 1(*c*) is a side elevation cross sectional view of the roadway section of FIG. 1(*b*) that has been raised by lifting the sunken slab and introducing fill material.

FIG. 1(*d*) is a side elevation cross sectional view of the roadway section of FIG. 1(*c*) with the hose deflated and a void left by the deflated hose filled with fill material.

FIG. 2(*b*) is a side elevation cross sectional view of the two adjacent slabs of FIG. 2(*a*) that have been raised by inflating the hoses and introducing fill material into a space that is created underneath the slabs.

FIG. 3(*b*) is a side elevation cross sectional view of the slab of FIG. 3(*a*) that has been raised by inflating the hoses and introducing fill material into a space that is created underneath the slab.

DETAILED DESCRIPTION

Figure 1A:
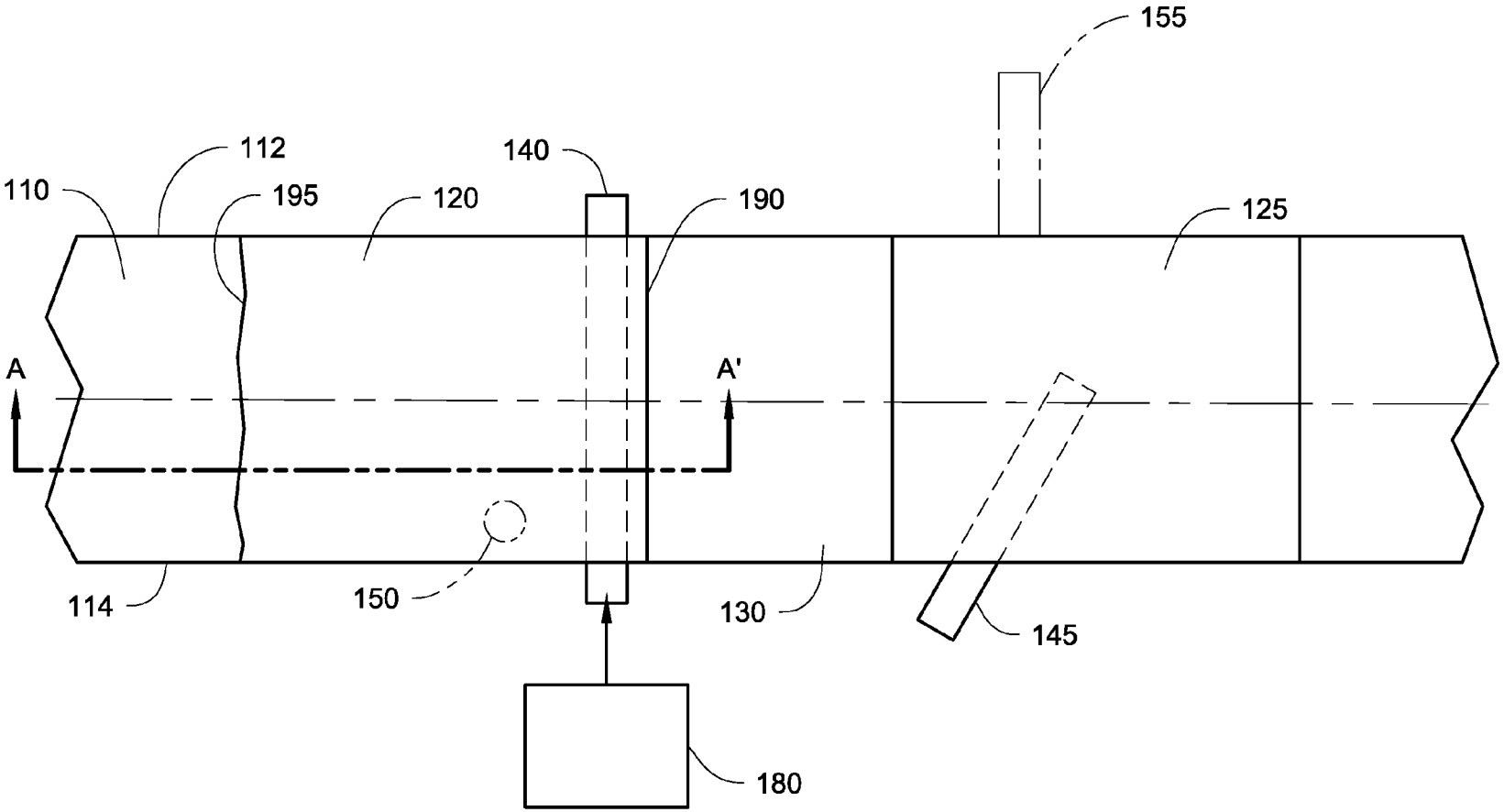
FIG. 1 (*a*) is a schematic top view of two sections of sunken roadway approaches to a bridge that illustrates the inventive concepts described herein.
Figure 1B:
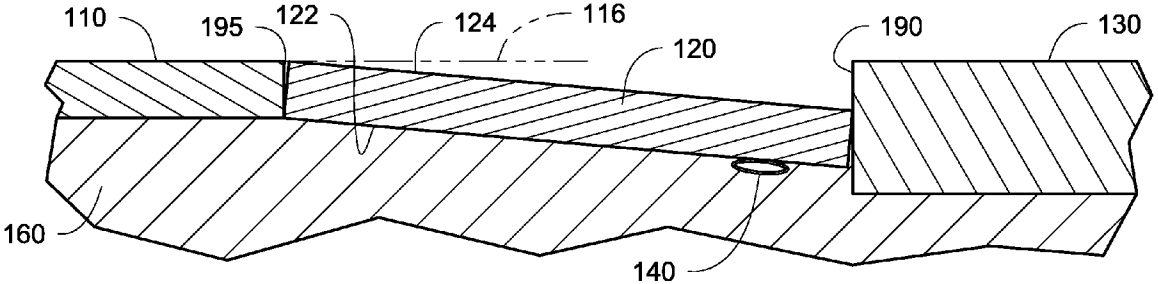
Figure 1C:
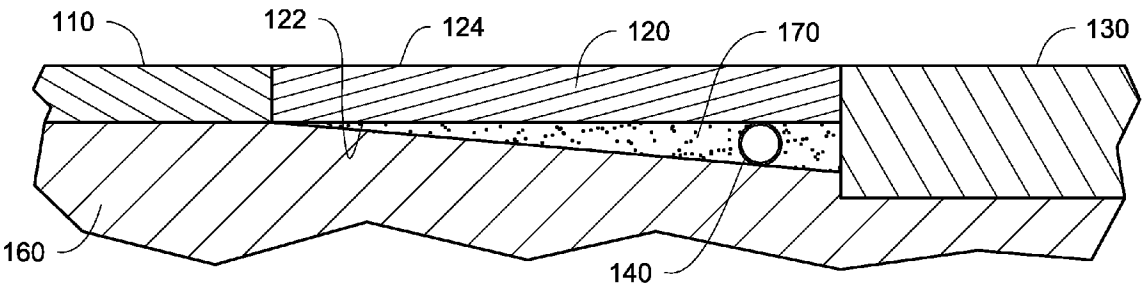
Figure 1D:
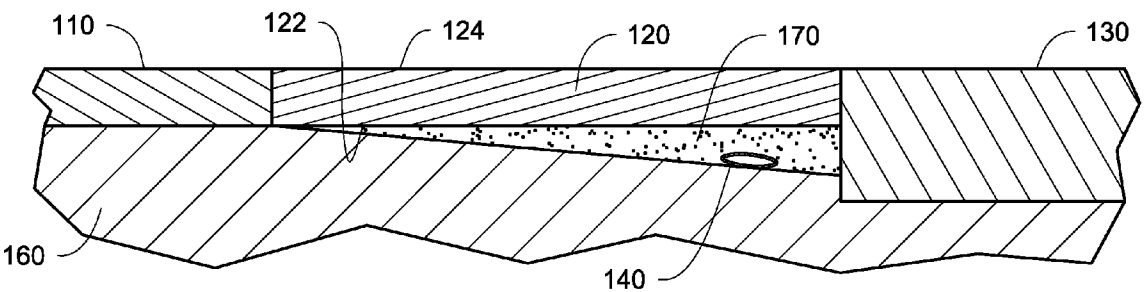

A method of raising a slab is described that raises slabs needing to be raised. For purposes of explaining the inventive concepts, the method will be described with respect to raising sunken slabs of roadways to align to their adjacent slabs without closing the roadway and breaking an ongoing traffic. However, the concepts described herein can be used to raise any slab needing to be raised, for example, slabs on driveways, garage floors, sidewalks, patios, etc. The slabs will generally be described as being formed from concrete. However, in appropriate circumstances, the concepts described herein may be used to raise slabs formed from asphalt.

With reference to FIGS. 1(*a*), (*b*), (*c*) and (*d*), a first embodiment of raising a sunken slab is illustrated. In the illustrated embodiment, two concrete approach slabs 120 and 125 to a bridge 130 have settled and need to be raised. The slabs 120, 125 are disposed on ground 160 which forms a roadbed underneath the slabs. The slabs 120, 125 are lifted using two inflatable holes 140 and 145, respectively, disposed underneath the slabs, and a space 170 that is created underneath each slab between the bottom of the slab and ground 160 when it is lifted is backfilled after the slabs are lifted.

The sunken slabs 120 and 125 need to be raised to align to the remaining roadway 110 and/or to the bridge 130. Although FIGS. 1(*a*)-(*d*) illustrate bridge approach slabs that have settled, the slabs can be any slabs needing to be raised, for example, slabs of sidewalks, driveways, patios, garage floors, etc.

The slab 120 has a bottom surface 122 and a top surface 124. The top surface 124 was at an original level 116 before the slab 120 subsided. In the illustrated mode of slab settlement, a step-like structure 190 is formed between one end of the slab 120 and the bridge 130, and a crack 195 is formed between the opposite end of the slab and the roadway 110. Other settlement modes can occur including, but not limited to, settlement where the left end of the slab adjacent the roadway 110 drops down relative to the right end adjacent the bridge, or where the slab settles such that both the right and left ends drop down. The slab 125 is similar to the slab 120 and is not separately described in detail.

Figure 2A:
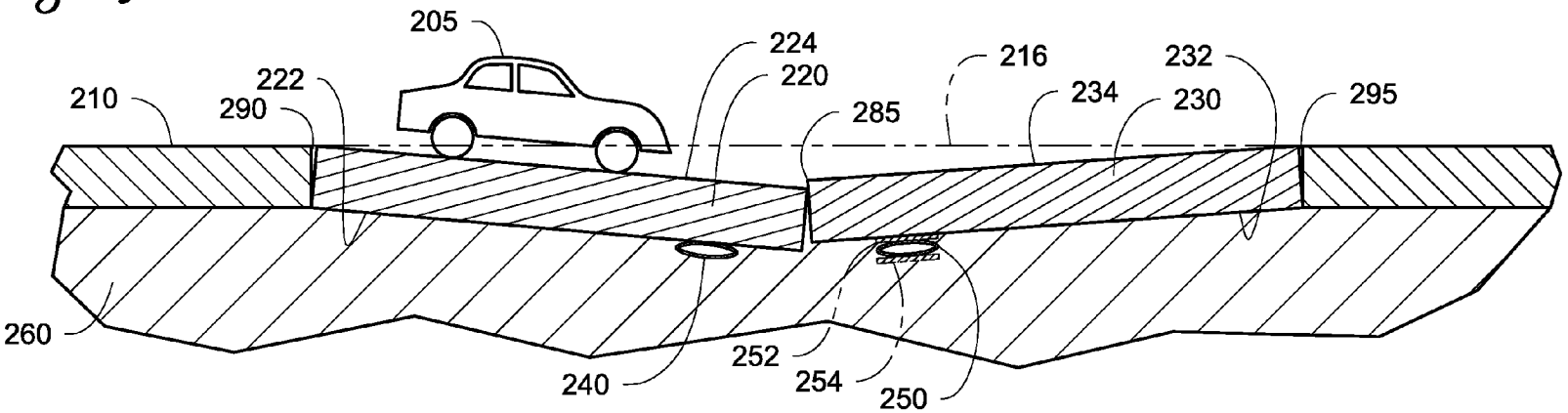
FIG. 2(*a*) is a side elevation cross sectional view of two adjacent sunken slabs needing to be raised.
Figure 2B:
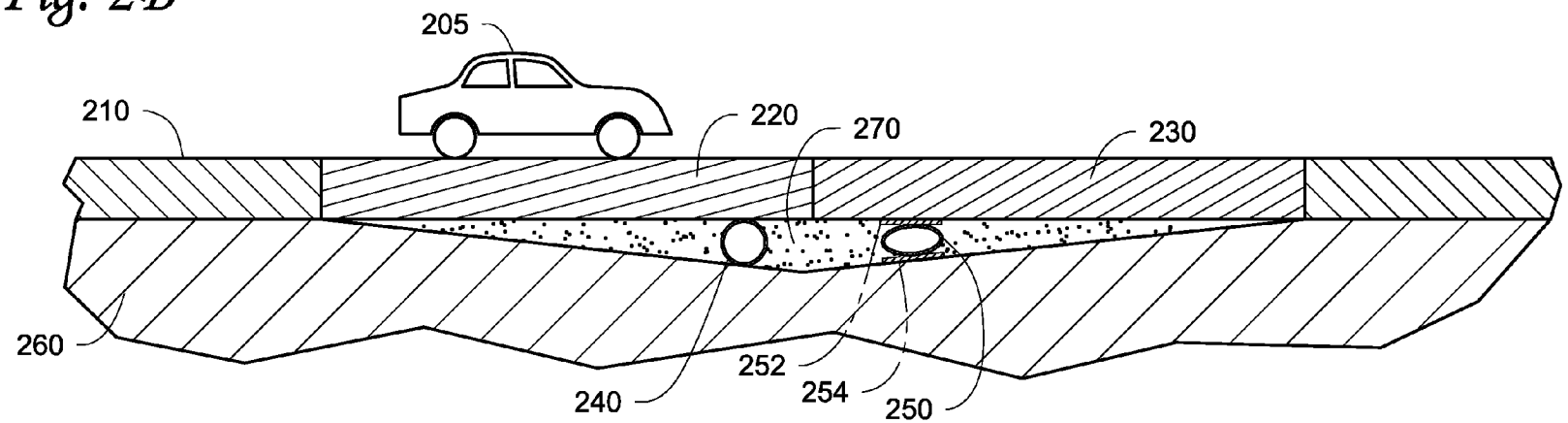

The inflatable hoses 140 and 145 are introduced underneath the approach slabs 120 and 125. The hoses are positioned underneath the slabs so as to be able to impose an upward lifting force on the slabs when the hoses are inflated. In the illustrated embodiment, the hoses 140 and 145 are disposed between the bottom surface of the slabs and the ground 160 in direct contact with the bottom surface of the respective slabs and the ground. However, a thin layer of dirt may exist between the hoses and the bottom surfaces of the slabs. In addition, as illustrated in FIGS. 2(*a*) and 2(*b*), plates 252, 254 may also be introduced between the bottom surface of the slab and the hose and/or between the hose and the ground to help to stabilize the hose relative to the slab and the ground.

Returning to FIG. 1(*a*), the slabs 120 and 125 may be pre-existing slabs and the inflatable hoses 140 and 145 are introduced underneath the slabs in an appropriate way. For example, the inflatable hoses can be introduced by using directional drilling to drill holes underneath the slabs, with the hoses then being directed through the holes. Alternatively, the hoses can be introduced while the slabs are being formed, whereby the hoses are laid on the roadbed and thereafter the slabs are formed.

The roadway 110 has a first side edge 112 and a second side edge 114. In the embodiment illustrated in FIG. 1(*a*), the hose 140 is introduced so that the hose 140 extends across the entire roadway from the first side edge 112 to the second side edge 114 generally perpendicular to the first and second edges 112 and 114. The hose 145 is illustrated as extending at an oblique angle from the second side edge 114 partially across the roadway to approximately the center of the roadway 110. The hose(s) can extend any distance across the roadway, can be located at any position along the slab relative to the ends thereof, and can be disposed at any angle relative to the side edges, that one finds suitable as long as the hose(s) is able to lift the slab needing to be raised.

Turning to FIG. 1 (*c*), the sunken portion of the slab 120 is raised by inflating the hose 140. The hose 140 is inflated with pressurized media so that the hose 140 increases in volume to impose an upward force on the slab 120. Suitable pressurized media for inflating the hose includes, but is not limited to, pressurized gases such as air and pressurized liquids such as water. The pressurized media can be generated from a pressurized media source 180 and is injected through one end of the hose 140 into the hose 140. The opposite end of the hose 140 can be closed to prevent escape of the pressurized media. Alternatively, the opposite end can be connected back to the media source 180 to form a closed loop circulation system.

The increase in size of the hose resulting from inflation creates an upward lifting force on the slab 120 that is sufficient to lift the slab. The size of the hose that is used should be sufficient to lift the slab upward a sufficient distance to raise the slab to the desired level. Further, the hose need not be fully inflated. The hose only need be inflated enough to raise the slab to the desired level. In addition, the size of the hose and pressure of the pressurized media should be sufficient to create enough upward lifting force to lift the weight of the slab. When it is desired to implement the method without closing the roadway and while there are objects such as cars or pedestrians on the slab 120 during lifting, the upward force should be sufficient to support both the slab 120 and the objects on the top surface of the slab 120. In this manner, the slab 120 can be raised without breaking ongoing traffic on the roadway 110.

Although the hose 140 is illustrated as having a cylindrical cross-sectional shape when fully inflated, hoses having other cross sectional shapes can be used, such as rectangle, polygon, oval or irregular shapes. For example, a hose 250 with an oval cross sectional shape when fully inflated is illustrated in FIG. 2 (*b*). The hose 140 can be made from any suitable material, such as rubber, canvas or nylon, so long as the hose 140 is inflatable to increase the volume from a collapsed or non-pressurized condition, and can hold the pressurized media when inflated.

Once the slab 120 is lifted by the inflated hose 140, the open space 170 is created underneath the raised slab. Fill material is then introduced into the space 170 to fill the space and restore support to the slab. The fill material can be any material suitable for filling the space 170. Examples of suitable fill material include, but are not limited to, dried fill material such as dried sand or wet fill material such as conventional mud used in mud-jacking. Dried fill materials are useful because they do not need time to dry. If wet fill material is used, drying time must be provided. An explanation of using dried sand to till voids underneath slabs is found in U.S. patent application Ser. No. 09/687,445 filed on Oct. 13, 2000, which is incorporated by reference in its entirety.

To introduce the fill material under the slab to fill the space 170, one or more through-holes 150 (see FIG. 1(*a*)) can be drilled through the slab 120 so that the fill material can be injected into the space 170 via the through-hole 150. Although one through-hole 150 is illustrated, any suitable number of through-holes can be drilled through the slab to achieve appropriate filling. The through-holes 150 can be disposed at any location on the slab 120 one finds suitable for backfilling the space 170. In the illustrated embodiment the through-hole 150 is disposed close to the edges 114 of the roadway 110 so that a central region of the roadway 110 can remain open for traffic, e.g., vehicles and pedestrians. After filling, the through-holes 150 are filled in an appropriate way, such as by using concrete fill material.

Alternatively, the fill material can be injected into the space 170 from the side of the road. For example, as shown in FIG. 1(*a*), an injection device 155 can be introduced into the space 170 from the side of the road to inject the fill material into the space 170.

Turning to FIG. 1(*d*), after the slab 120 is lifted and the space is filled with fill material, the hose 140 is deflated. Deflation of the hose 140 leaves a void resulting from the space occupied by the inflated hose. Additional fill material is then introduced again to fill the void. As shown in FIG. 1 (*d*), the sunken slab is thus returned to its original level 116.

FIGS. 2(*a*) and (*b*) illustrate another embodiment where two adjacent slabs 220 and 230 have settled and are raised using two inflatable hoses 240 and 250 and a space 270 underneath each slab is backfilled after the slabs 220 and 230 are lifted. Referring to FIG. 2(*a*), the two sunken slabs 220 and 230 form part of a roadway supported on the ground 260. The two slabs 220 and 230 have adjacent ends that have settled creating a step-like structure 285 and two cracks 290 and 295. Each slab 220 and 230 has a bottom surface 222 and 232 and a top surface 224 and 234, respectively. The top surfaces 224 and 234 were at an original level 216 before the slabs settled.

The two inflatable hoses 240 and 250 are positioned underneath the adjacent portions of the two slabs 220 and 230 needing to be raised. The hose 240 has a round cross section shape when fully inflated and the hose 250 has an oval cross section shape when fully inflated. The slabs 220 and 230 may be pre-existing slabs and the inflatable hoses 240 and 250 are introduced underneath them in an appropriate way. Alternatively, the inflatable hoses can be introduced while the slabs are being formed.

As discussed above, the two plates 252 and 254 can be used, if considered appropriate, between the slab 230 and the hose 250 and between the hose 250 and the ground 260, respectively. The plates may be introduced at the same time as the hoses or they can be introduced after the hoses have been installed. The use of plates may be appropriate if there is concern about the stability of the ground or the slab as the hose reacts against it, if one wishes to spread the lifting force more evenly, or if there are concerns about creating punctures in the hose when pressurized media is introduced into the hose.

The lifting the slabs 220, 230 can be performed while an automobile 205 is traveling on the slabs as shown in FIGS. 2(*a*) and 2(*b*).

Although one hose is illustrated in FIGS. 2(*a*) and 2(*b*) to raise each slab, two or more hoses can be used underneath each slab. In addition, the two slabs could also be raised using only one of the hoses by introducing the hose underneath both of the slabs at a position to provide a lifting force to each slab when inflated.

The hoses 240 and 250 are inflated with pressurized media so that each hose increases in volume to impose an upward lifting force on the respective slabs. The pressurized media can be introduced into the hoses and can be same type of media as discussed above for FIGS. 1(*a*) to 1(*d*). The upward force on the slab 220 is sufficient to support both the slab 2200 and the car 205 on the slab 220. In this manner, ongoing traffic on the slabs need not be interrupted during raising the sunken slabs.

As shown in FIG. 2(*b*) once the slabs are raised by inflating the hoses 240, 250, fill material is introduced into the created space 270 underneath the slabs 240, 250. The fill material can be any material suitable for filling the space 270. Examples of suitable fill material include, but are not limited to, dried fill material such as dried sand or wet fill material such as conventional mud used in mud-jacking.

After the slabs 220 and 230 are lifted and the space back-filled to raise the slabs to the original level 216, the hoses 240 and 250 would be deflated which leaves voids resulting from the space occupied by the inflated hose. Fill material is again introduced to fill the voids.

Figure 3A:
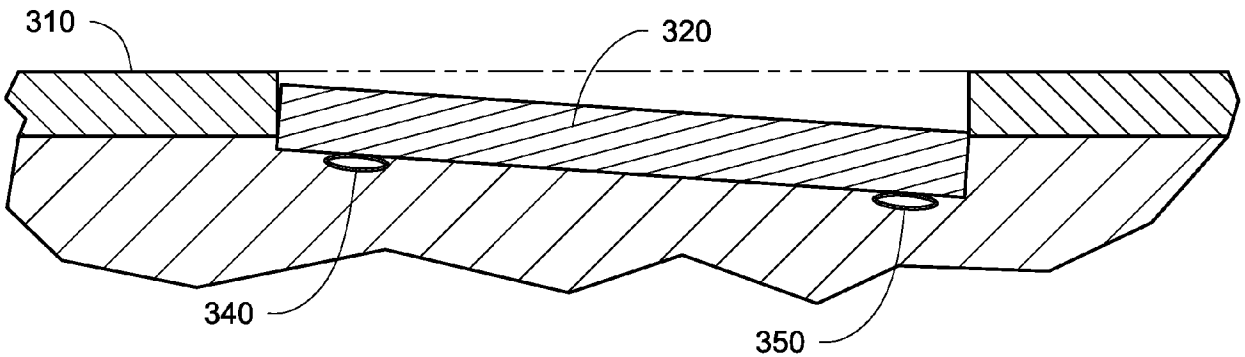
FIG. 3(*a*) is a side elevation cross sectional view of a sunken slab illustrating the use of a plurality of inflatable hoses to raise the slab.
Figure 3B:
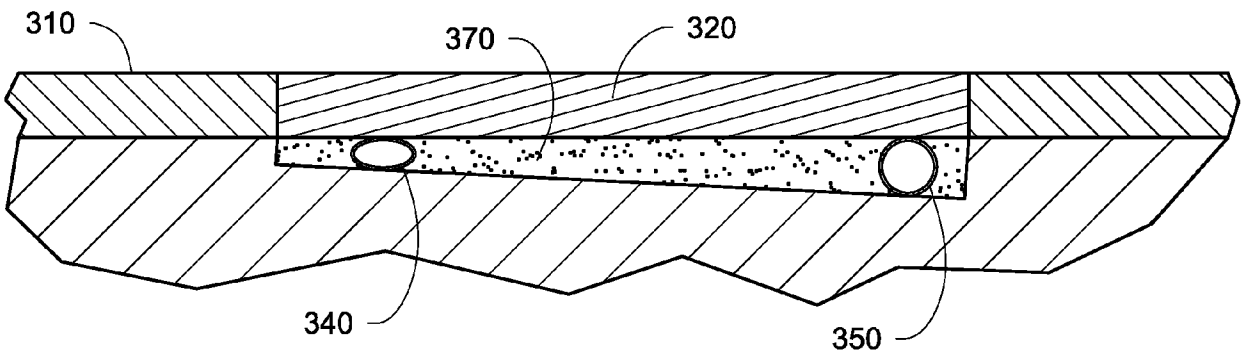

FIGS. 3(*a*) and (*b*) illustrate a sunken slab 320 that forms part of a sidewalk 310. The slab 320 is lifted using two hoses 340 and 350, and a space 370 created under the lifted slab is back filled with fill material. The two hoses 340, 350 are positioned underneath two portions of the slab 320 near opposite ends thereof. The slab 320 is raised by inflating the hoses 340 and 350 and then by introducing fill material into the space 370 underneath the slab 320.

Both hoses 340 and 350 have a cylindrical structure when being fully inflated. However, FIG. 3(*b*) shows the hose 340 as being partially inflated while the hose 350 is fully inflated. How much each hose is inflated depends on how high the slab needs to be lifted.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of raising a slab resting on the ground, comprising:

introducing an inflatable hose underneath at least a portion of the slab needing to be raised, the inflatable hose being disposed between a bottom surface of the slab and the ground; and lifting the slab by inflating the hose with pressurized media so that the hose increases in volume to impose an upward force on the slab.

2. The method of claim 1, further comprising introducing fill material into a space that is created underneath the slab when the slab is lifted.

3. The method of claim 2, wherein the fill material comprises dried fill material.

4. The method of claim 3, wherein the dried fill material comprises sand.

5. The method of claim 2, further comprising deflating the hose and thereafter introducing fill material into a void left by deflating the inflated hose.

6. The method of claim 2, wherein the slab comprises a roadway and the ground comprises a roadbed.

7. The method of claim 6, wherein the roadway comprises an approach slab to a bridge and the approach slab has settled.

8. The method of claim 6, wherein the roadway includes a first side edge and a second side edge, and the hose is introduced so that the hose extends from the first side edge to the second side edge generally perpendicular to the first and second side edges.

9. The method of claim 2, comprising introducing a plurality of hoses underneath the slab needing to be raised, each hose being disposed between a bottom surface of the slab and the ground.

10. The method of claim 1, wherein the upward force on the slab is sufficient to support both the slab and objects on the slab.

11. The method of claim 1, wherein introducing comprises introducing the hose under a pre-existing slab, or introducing the hose while the slab is being formed.

12. The method of claim 1, wherein the pressurized media comprises air.

13. A method of slab jacking, comprising:

positioning an inflatable hose underneath at least a portion of a slab needing to be raised, the inflatable hose being positioned underneath the slab so as to be able to impose an upward lifting force on the slab when the hose is inflated;

inflating the hose with pressurized media so that the hose increases in volume to impose an upward force on the slab to lift the slab;

introducing fill material into a space that is created underneath the slab when the slab is lifted; and thereafter deflating the inflated hose and introducing fill material into a void left by deflating the inflated hose.

14. The method of claim 13, wherein the fill material comprises dried fill material.

15. The method of claim 14, wherein the dried fill material comprises sand.

16. The method of claim 13, wherein the slab comprises a roadway and the ground comprises a roadbed.

17. The method of claim 16, wherein the roadway comprises an approach slab to a bridge and the approach slab has settled.

18. The method of claim 16, wherein the roadway includes a first side edge and a second side edge, and the inflatable hose is positioned so that the hose extends from the first side edge to the second side edge generally perpendicular to the first and second side edges.

19. The method of claim 13, comprising positioning a plurality of inflatable hoses underneath the slab needing to be raised.

20. The method of claim 13, wherein the slab is a pre-existing slab or a slab that is being formed.

* * * * *